US007062881B2

(12) United States Patent
Rissone

(10) Patent No.: US 7,062,881 B2
(45) Date of Patent: Jun. 20, 2006

(54) DOOR THRESHOLD

(76) Inventor: Robert Rissone, 13 Silver St., Rochester, NY (US) 14611

( * ) Notice: Subject to any disclaimer, the term of this patent is extended or adjusted under 35 U.S.C. 154(b) by 0 days.

(21) Appl. No.: 10/751,299

(22) Filed: Jan. 5, 2004

(65) Prior Publication Data

US 2004/0168381 A1 Sep. 2, 2004

Related U.S. Application Data

(60) Provisional application No. 60/437,747, filed on Jan. 3, 2003.

(51) Int. Cl.
*E06B 1/70* (2006.01)

(52) U.S. Cl. ..... 49/467; 52/211; 52/212; 52/177; 52/717.04; 52/718.01; 52/718.04; 52/210; 49/471; 49/475.1

(58) Field of Classification Search ..... 52/204.1, 52/205, 210, 211, 212, 213, 217, 177, 179, 52/273, 461, 464, 466, 467, 716.1, 717.03, 52/717.04, 717.05, 717.06, 718.01, 718.03, 52/718.04, 285.1, 470, 772, 573.1, 788.1; 16/16, 4, 7, 17.1; 49/467–471, 506, 475.1; 403/300, 305, 292, 13, 28, DIG. 10, 405.1
See application file for complete search history.

(56) References Cited

U.S. PATENT DOCUMENTS 2,796,624 A * 6/1957 Speer ..... 16/16
2,949,651 A * 8/1960 Hill ..... 49/493.1
3,543,326 A * 12/1970 Rohrberg et al. ..... 16/16
3,696,461 A * 10/1972 Kelly ..... 16/16
4,104,830 A * 8/1978 Eagle ..... 49/468
4,185,417 A * 1/1980 McKann ..... 49/470
4,310,991 A * 1/1982 Seely ..... 49/470
4,387,535 A * 6/1983 Corbo ..... 49/468
4,807,392 A * 2/1989 Kirk ..... 43/131
4,823,010 A 4/1989 Kornbrekke et al.
4,913,576 A * 4/1990 Grant, Jr. ..... 403/13
5,065,263 A * 11/1991 Yoshida et al. ..... 360/77.03
5,067,279 A 11/1991 Hagemeyer
5,083,400 A * 1/1992 Bowman ..... 49/468
5,150,544 A * 9/1992 Burnett ..... 49/493.1
5,174,065 A * 12/1992 Schlicht ..... 49/489.1
5,214,880 A * 6/1993 Woodruff et al. ..... 49/490.1
5,542,217 A * 8/1996 Larivee, Jr. ..... 49/471
5,553,419 A 9/1996 Jenkins, II
5,577,349 A 11/1996 Rissone (Continued)

OTHER PUBLICATIONS

U.S. Appl. No. 60/437,747 filed Jan. 3, 2003.

*Primary Examiner*—Jeanette E. Chapman
(74) *Attorney, Agent, or Firm*—Nixon & Vanderhye P.C.

(57) ABSTRACT

A door threshold may include upper and lower members for sandwiching carpet and/or carpet padding therebetween. The threshold may, in certain example embodiments, grip the carpet in order to prevent it from being pulled out from between the upper and lower threshold members. Thus, in certain example instances, the need for tacks (or carpet tack strip(s)) proximate the threshold can be reduced and/or eliminated. In certain example embodiments of this invention, the threshold structure may include a locating bracket that is provided proximate the door frame for frame alignment and security purposes, and/or one or more pans located under the threshold for locating and/or securing purposes. Levelers, shims and/or the like may be used in certain example embodiments in order to compensate for non-level flooring proximate the door.

12 Claims, 18 Drawing Sheets

U.S. PATENT DOCUMENTS 5,657,598 A * 8/1997 Wilbs et al. ..... 52/287.1
5,857,291 A * 1/1999 Headrick ..... 49/368
6,058,654 A 5/2000 Rissone
6,244,636 B1 6/2001 Rissone
6,266,924 B1 7/2001 Rissone
6,371,188 B1 * 4/2002 Baczuk et al. ..... 160/92
6,374,545 B1 * 4/2002 Baczuk ..... 49/470
6,381,905 B1 5/2002 Rissone
6,442,901 B1 * 9/2002 Rissone ..... 49/470
6,550,192 B1 * 4/2003 Nelson et al. ..... 52/177
6,553,616 B1 * 4/2003 Johnson ..... 16/16
6,789,358 B1 * 9/2004 Procton et al. ..... 49/471
6,789,359 B1 * 9/2004 Bauman et al. ..... 49/471
D499,819 S * 12/2004 Glatz ..... D25/164

* cited by examiner

No carpet tack needed at threshold in front of the door.

Threshold is set under the door.

FIXED. NOT ADJUSTABLE.

ADJUSTABLE DOOR BOTTOM

DOOR THRESHOLD

This application claims priority on U.S. Provisional Patent Application No. 60/437,747, filed Jan. 3, 2003, the disclosure of which is hereby incorporated herein by reference.

This invention relates to a door threshold. More particular, certain example embodiments of this invention relate to a door threshold that permits certain installation sequencing/issues to be controlled in varying degrees, addresses issues of security, and/or allows for improved practical uses. Door thresholds according to certain example embodiments of this invention may be used in the context of fire doors or any other suitable door application.

BACKGROUND OF THE INVENTION

FIG. 1 illustrates a known door threshold. In FIG. 1, threshold 1 serves as a carpet divider, is located under the door, and includes at least one overhang 3 under which carpet 4 and carpet pad 6 can be run. The FIG. 1 threshold is typically made of aluminum.

Unfortunately, threshold 1 of FIG. 1 requires the presence of carpet tacks 5 and supports 7 therefor proximate the overhangs 3 in order to fasten down the carpet 4 so as to prevent the carpet from slipping out from over the overhangs 3. However, if the carpet 4 wears out, or tears, tacks 5 tend to poke through the carpet and can be a hazard since they can injure feet of a person walking near the threshold.

Thus, it will be appreciated by those skilled in the art that there exists a need in the art for an improved door threshold(s).

BRIEF SUMMARY OF THE INVENTION

Certain example embodiments of this invention relate to a door threshold which includes upper and lower members for sandwiching carpet and/or carpet padding therebetween. In certain example embodiments, the pad may stop short of the lower member so that only the carpet extends between and is sandwiched by the upper and lower members of the threshold. The threshold may, in certain example embodiments, grip the carpet in order to prevent it from being pulled out from between the upper and lower threshold members. Thus, in certain example instances, the need for tacks (or carpet tack strip(s)) proximate the threshold can be reduced and/or eliminated. Moreover, this may also allow for a variety of carpet and/or pad thicknesses, and can maintain a slight rise above the carpet for a door sweep to seal against and yet not significantly rub on the carpet while closing.

In certain example embodiments of this invention, the threshold structure may include a bracket that is provided proximate the door frame for frame alignment and security purposes. An example goal of the bracket is to help the door frame to be set to the desired width. The threshold may be fit or attached to the bracket, so that the threshold structure is effectively used as a template for setting the frame.

In certain other example embodiments of this invention, the threshold structure may include one or more pan(s) located at least partially beneath the threshold. Such pan(s) may be attached to the frame and/or floor, and may be used to help the frame to be installed and/or maintained at the proper desired width. Moreover, the pan(s) may be provided with one or more tabs for securing the threshold in a desired position(s). Such pan(s) may be used in combination with the aforesaid bracket(s) in certain example embodiments of this invention, and/or may also be used in combination with leveler(s), shim(a) or the like for providing the threshold structure at a desired level.

In certain example embodiments of this invention, there is provided a door threshold structure to be at least partially located beneath a door when the door is in a closed position, the door threshold structure comprising: a door threshold including a main body; wherein, on at least one side of the main body of the door threshold, there are provided upper and lower members extending from the main body in spaced apart relation from one another so that the upper and lower members are at least partially substantially parallel to one another; and wherein a gap between the spaced apart upper and lower members receives an end of a carpet.

In other example embodiments of this invention, there is provided a door threshold to be located at least partially under a bottom surface of a door when the door is in a closed position; a bracket to be mounted to a door frame adjacent the threshold, wherein the bracket comprises first and second spaced apart vertically extending members; wherein the first vertically extending member of the bracket is attached to the door frame; and wherein the second vertically extending member of the bracket is located at least partially in a slit defined in a bottom surface of the door threshold.

In still further example embodiments of this invention, there is provided a door threshold structure comprising: a door threshold to be located at least partially under a bottom surface of a door when the door is in a closed position; an elongated pan mounted to opposing sides of a door frame, and further being located at least partially beneath the door threshold; the pan comprising first and second spaced apart sidewalls; and wherein the door threshold is mounted on the pan at least partially between the first and second spaced apart sidewalls of the pan.

DETAILED DESCRIPTION OF EXAMPLE EMBODIMENTS OF THE INVENTION

Figure 1:
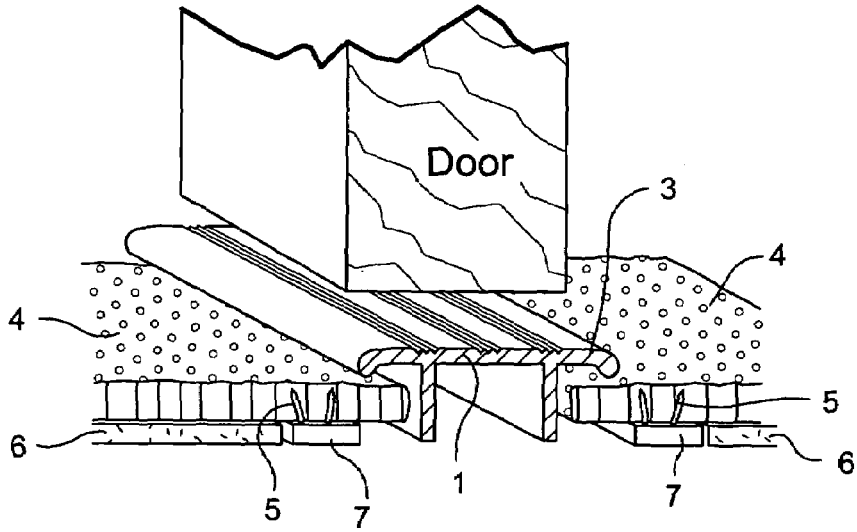
Fig. 1 (Prior Art)
FIG. 1 is a perspective view of a conventional door threshold structure.

Referring now more particularly to the accompanying drawings in which like reference numerals indicate like parts throughout the several views.

Figure 2:
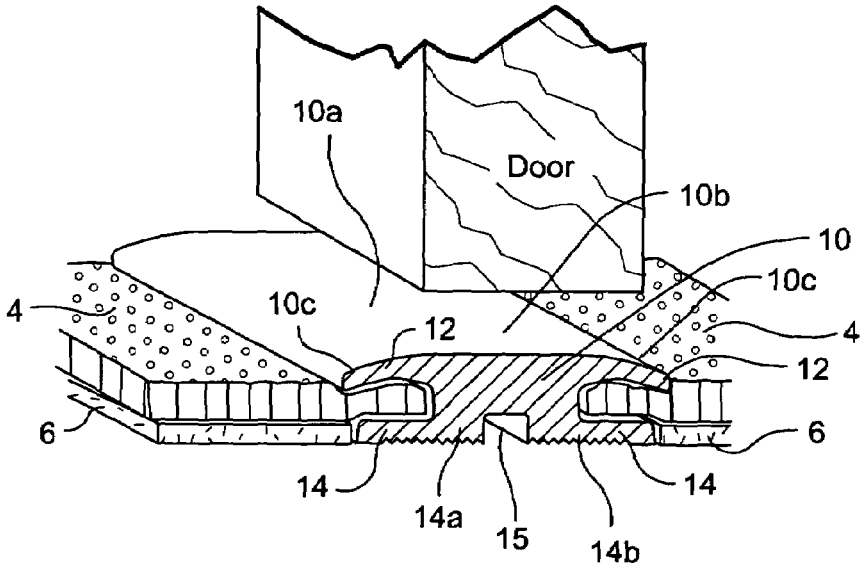
FIG. 2 is a perspective view of a door threshold according to an example embodiment of this invention.

FIG. 2 is a perspective view of a door threshold 10 according to an example embodiment of this invention. Threshold 10 may be made of or comprise aluminum or any other suitable material in different embodiments of this invention. Threshold 10, on one or both sides thereof, includes upper and lower members, 12 and 14 respectively, which sandwich an end of carpet 4 therebetween. As shown in FIG. 2, carpet pad 6 preferably stops short of the lower member 14 so that only the carpet 4 is sandwiched between the upper and lower members 12 and 14 in certain example embodiments of this invention (although this need not be the case in all embodiments). In certain example embodiments, at least parts of the upper and lower members 12 and 14 are substantially parallel (i.e., parallel plus/minus about 20 degrees) to one another.

In certain example embodiments, upper and/or lower member(s) 12, 14 grip or otherwise maintain the carpet 4 that is located therebetween. Thus, the need for carpet tacks proximate the threshold is reduced and/or eliminated, since the threshold itself maintains the end of the carpet in position and prevents it from being easily pulled out from between members 12, 14. Overhang 12 may be flexible in certain example embodiments of this invention, so as to provide a downward-directed biasing force against the carpet 4 to help maintain the end of the carpet between members 12 and 14. The threshold further allows for a variety of different carpet and/or pad thicknesses, and can maintain a slight rise above the carpet for a door sweep to seal against and yet not rub or significantly rub on the carpet when closing.

Carpeting 4 is typically glued down or stretched and held by carpet tack strips along the walls. At the door opening, the carpet cannot be glued to a pad typically. The carpet tuck feature of threshold 10 effectively grips the carpet and prevents it from being easily pulled away from the threshold. The carpet will have been stretched and held at either side of the door opening.

As shown in FIG. 2, the top surface 10*a* of the threshold 10 includes a peak or highest elevation portion 10*b*. Then, the top surface 10*a* preferably slopes downwardly from peak 10*b* on both sides thereof to lower elevation portions 10*c*. The top surfaces of lower elevation portions 10*c* typically are sloped from about 5 to 60 degrees, more preferably from about 10 to 35 degrees, relative to the a top flat portion of peak 10*b*. Moreover, as shown in FIG. 2, the bottom member or base 14 of the threshold may be divided into two separate and distinct feet 14*a* and 14*b* that are separated from one another by gap or cavity 15. Typically, the gap or cavity 15 is located under the peak portion 10*a* of the threshold. Feet 14*a*, 14*b* are preferably attached to the floor (or other support located over the floor) via adhesive, screws, or the like. The door frame may be made of steel, aluminum, wood, or any other suitable material.

Figure 3A:
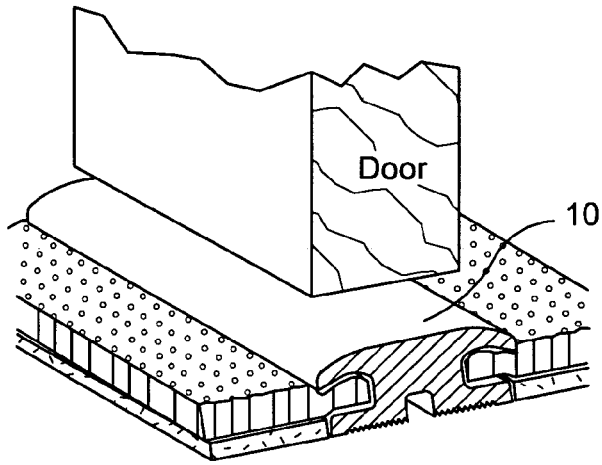
FIGS. 3(*a*), 3(*b*) and 3(*c*) are perspective views illustrating various locations proximate a door frame where the threshold of FIG. 2 may be located in different embodiments of this invention.
Figure 3B:
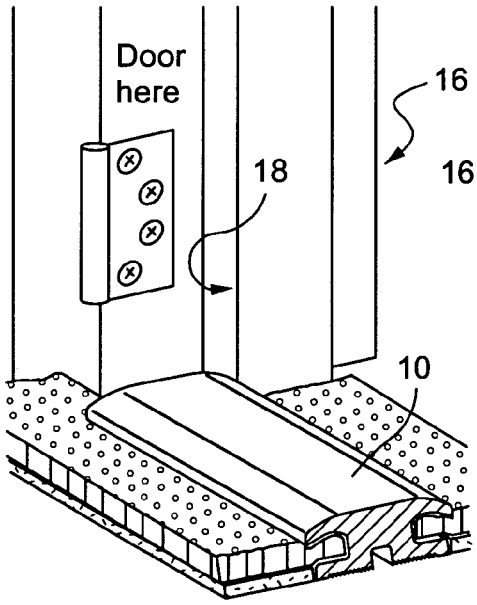
Figure 3C:
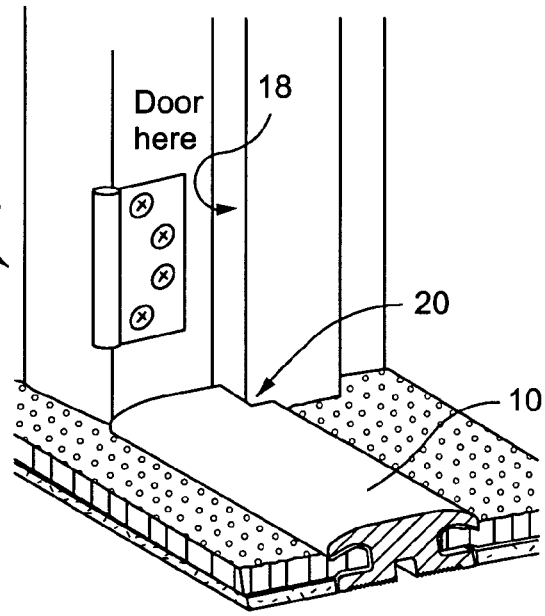

FIG. 3(*a*) is a perspective view of the threshold 10 of FIG. 2, illustrating that the door is typically located, in a closed position, directly over the threshold 10. Meanwhile, FIGS. 3(*b*) and 3(*c*) illustrate various possible positions within the door frame 16 for locating the threshold 10. In FIG. 3(*b*), the threshold 10 is located on one side of the door frame's stop 18 and has no notch defined therein for locating or accommodating the stop 18. Alternatively, as shown in FIG. 3(*c*), the threshold 10 may have a notch 20 defined in a corner area of an end thereof, the notch 20 for fitting attaching around multiple sides of the stop 18. Notch 20 may be substantially L-shaped in certain example embodiments of this invention.

Figure 4A:
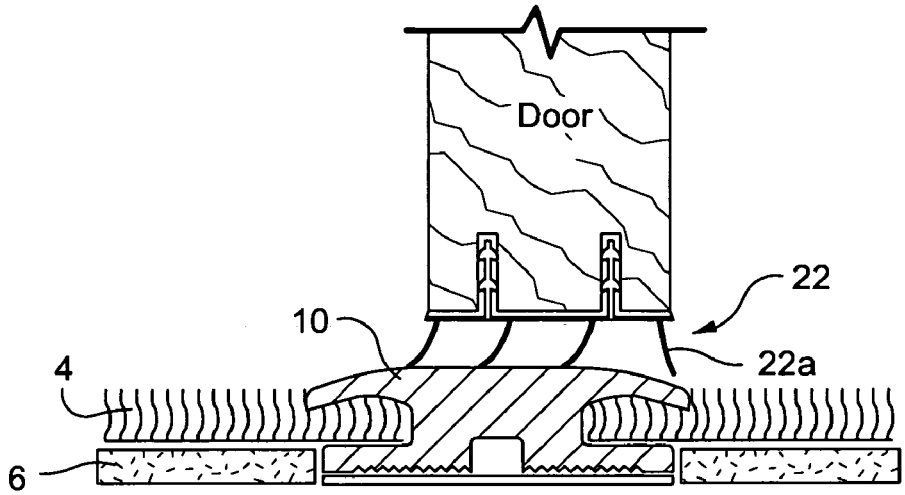
FIGS. 4(*a*) and 4(*b*) are side cross sectional views illustrating the thresholds of FIGS. 2–3 being used in combination with various types of sweeps or door bottoms which are located on the corresponding door bottom.
Figure 4B:
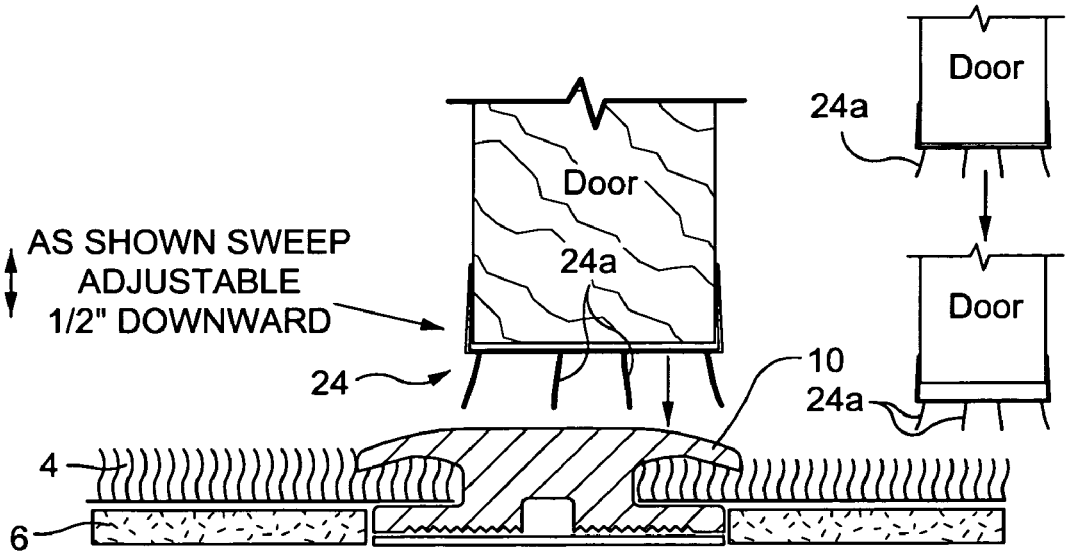

FIGS. 4(*a*) and 4(*b*) illustrate different types of sweeps or door bottoms that may be used on bottoms of doors in conjunction with thresholds according to different embodiments of this invention. One type of door bottom or sweep 22 is fixed and assumes a fairly level floor (FIG. 4(*a*)). However, the flexible fins 22*a* may be flexible enough to compensate for a floor that is not precisely level. While this may be practical for a door that is hand shut, it presents some issues for doors that close and lock automatically by way of a door closer or spring hinges. In the case of fire doors the closing forces by certain codes may be only five pounds; and if there is any bind between the sweep and the threshold the door may not properly shut and lock. Thus, needs arise for adjustable sweeps as shown in FIG. 4(*b*). Such adjustable sweeps 24 may mortise into the bottom of the door, or alternatively may be of the type shown in FIG. 4(*b*) which fits over the door bottom. Such adjustable sweeps, including flexible fins 24*a* for sealing purposes, can be adjusted to compensate for thresholds that are not level.

Figure 5A:
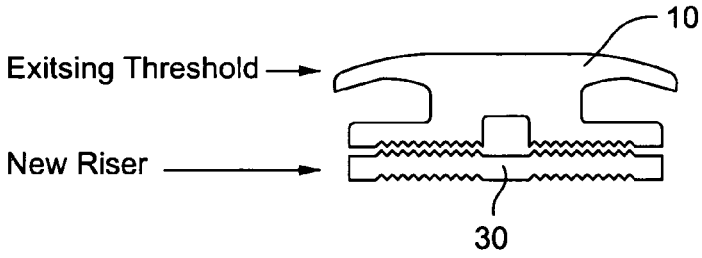
FIGS. 5(*a*) and 5(*b*) are side cross sectional views showing the threshold of FIGS. 2–3 being used with an example interlocking elevator or riser according to an example embodiment of this invention.
Figure 5B:
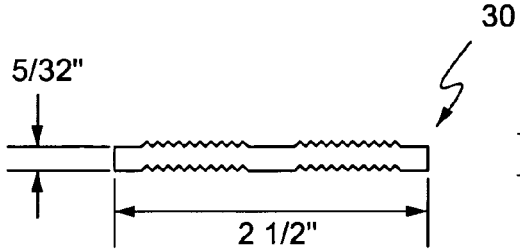
Figure 6A:
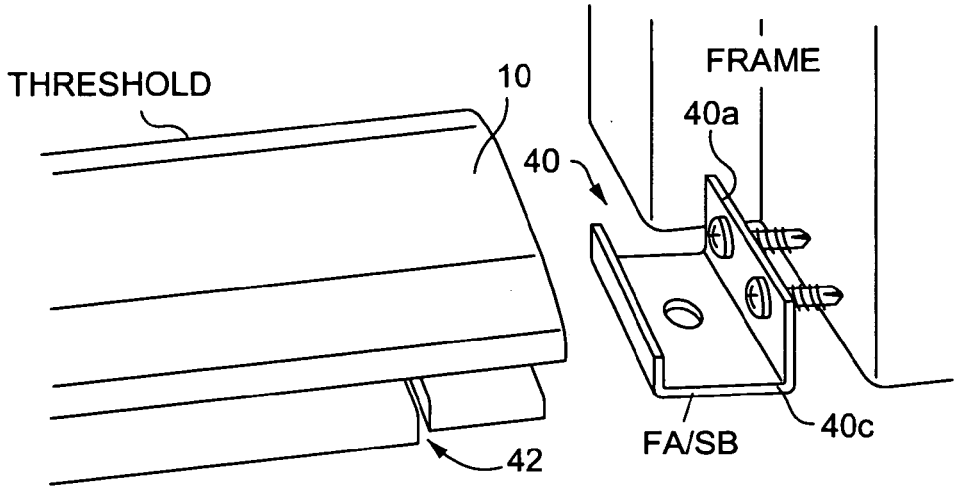
FIGS. 6(*a*), 6(*b*), 6(*c*) and 6(*d*) illustrate a door threshold structure according to another example embodiment of this invention, wherein the structure includes a door threshold similar to that of FIG. 2 being used in combination with a locating bracket which is attached to the door frame.
Figure 6B:
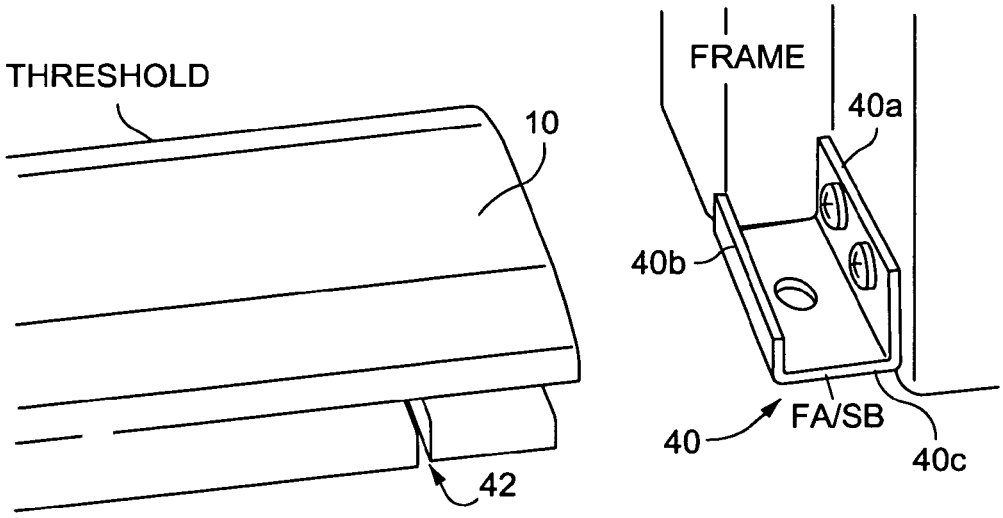
Figure 6C:
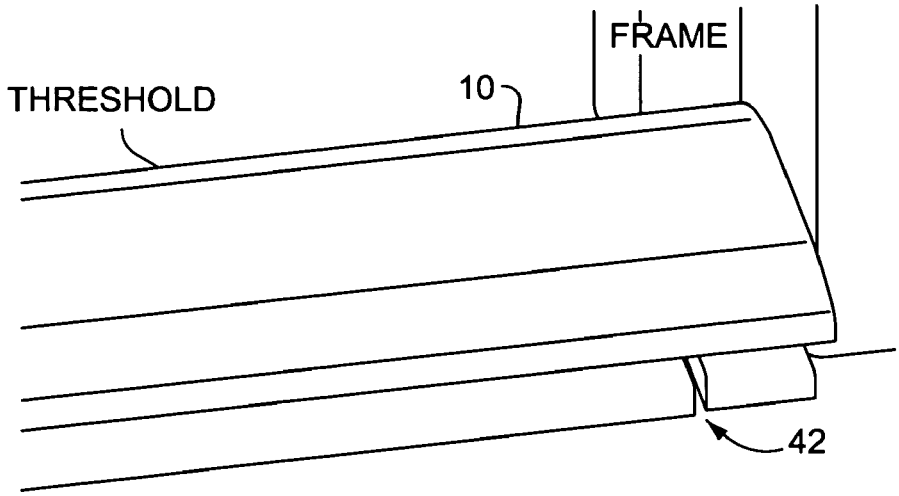
Figure 6D:
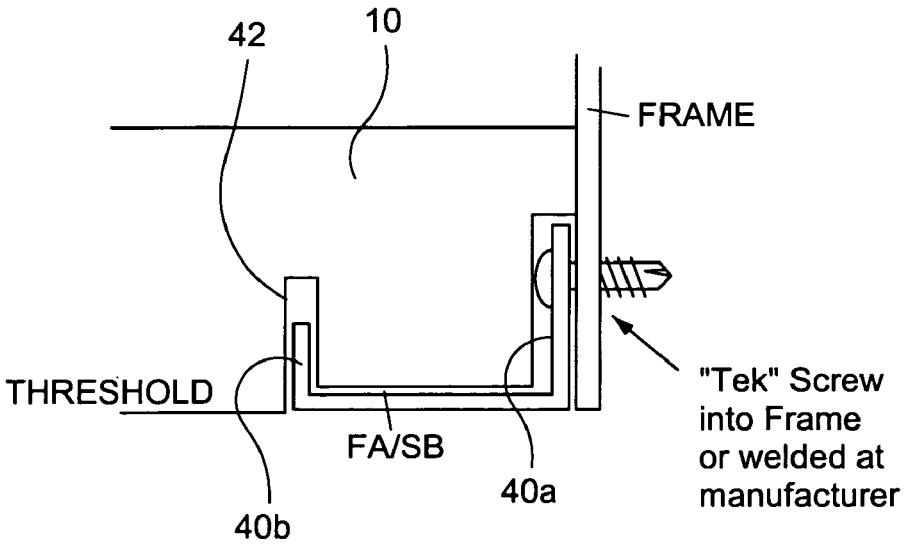
Figure 7A:
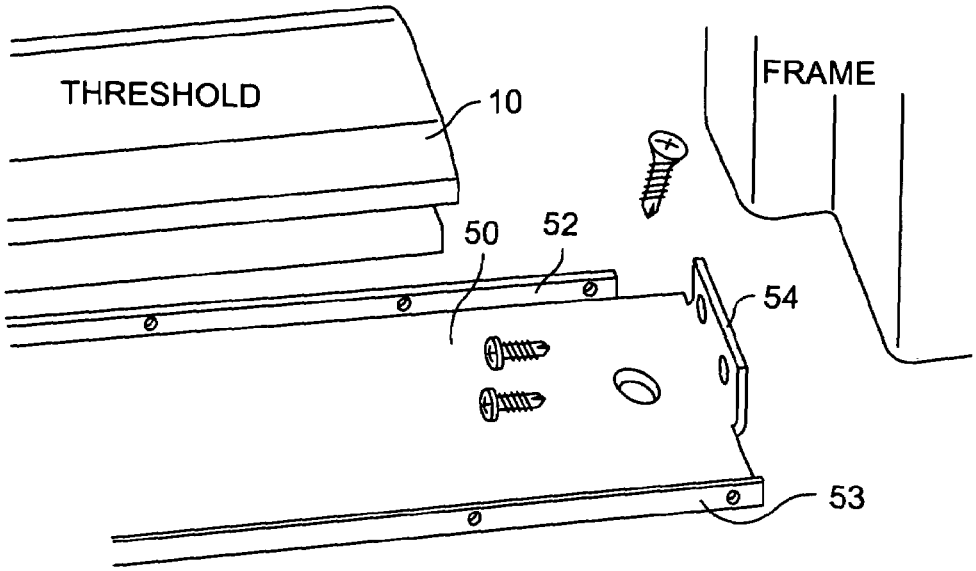
FIGS. 7(*a*), 7(*b*), 7(*c*) and 7(*d*) illustrate a door threshold structure according to another example embodiment of this invention, wherein the structure includes a door threshold similar to that of FIG. 2 being used in combination with a pan which is attached to the door frame beneath the threshold.
Figure 7B:
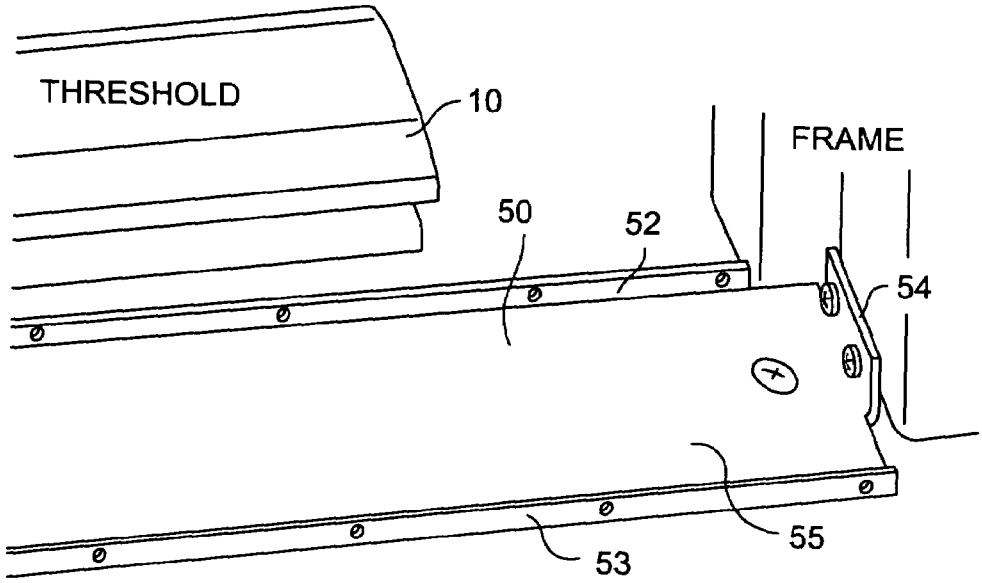
Figure 7C:
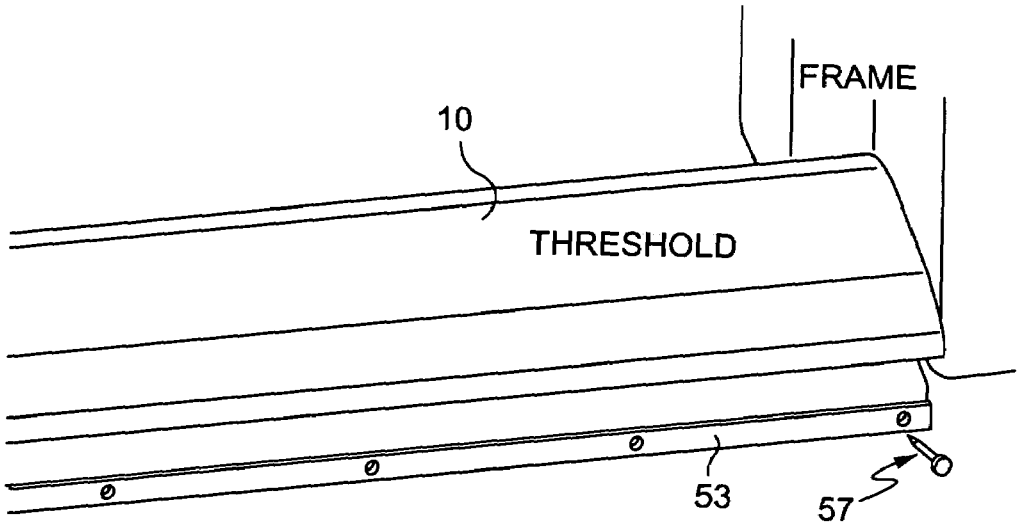
Figure 7D:
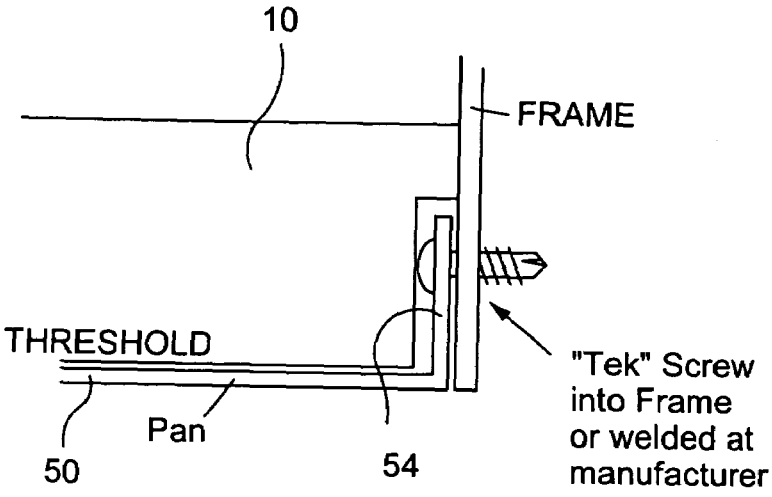
Figure 8A:
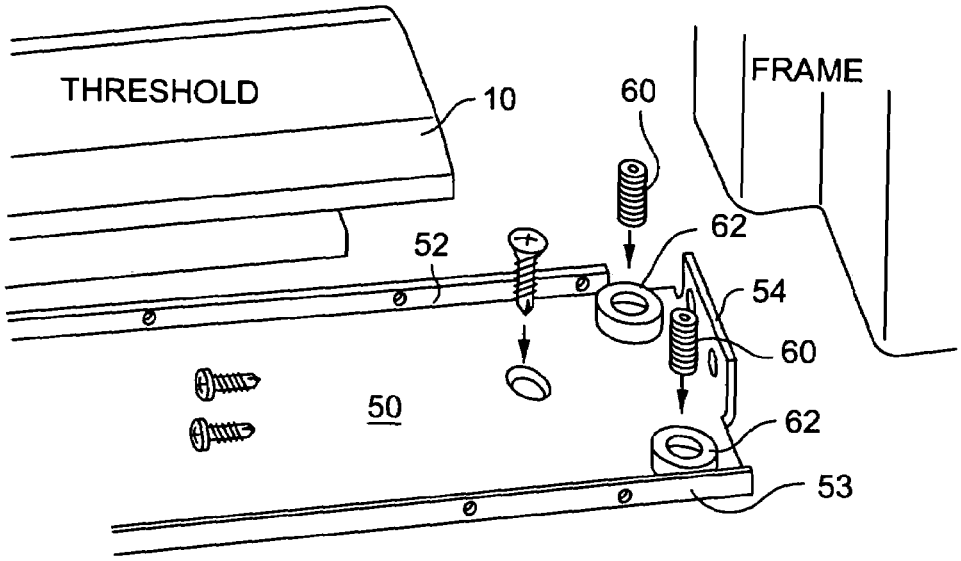
FIGS. 8(*a*), 8(*b*), 8(*c*) and 8(*d*) illustrate a door threshold structure according to another example embodiment of this invention, wherein the structure includes a door threshold similar to that of FIG. 7 being used in combination with a pan which is attached to the door frame beneath the threshold and a plurality of levelers for allowing easy adjustments to be made when non-level floors are encountered.
Figure 8B:
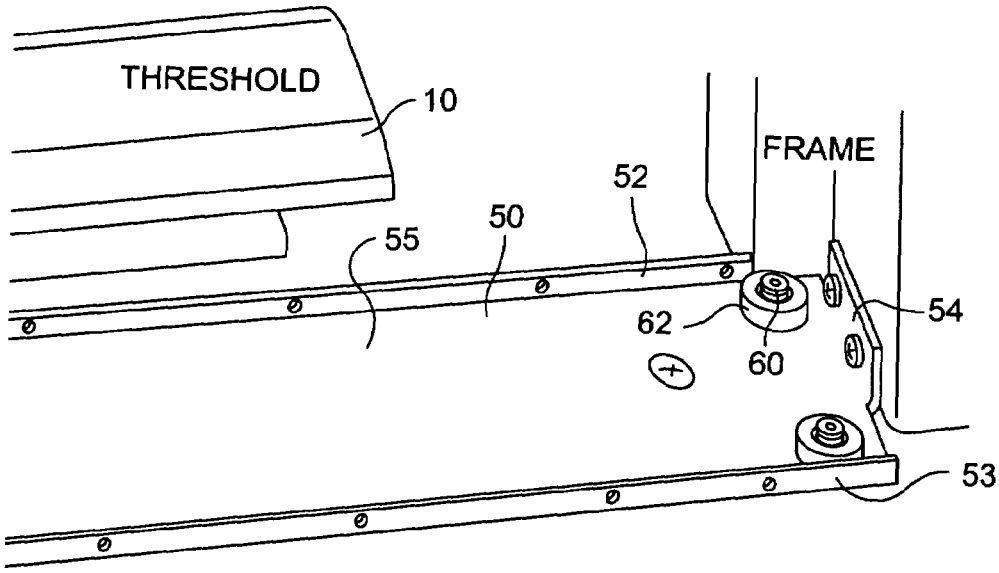
Figure 8C:
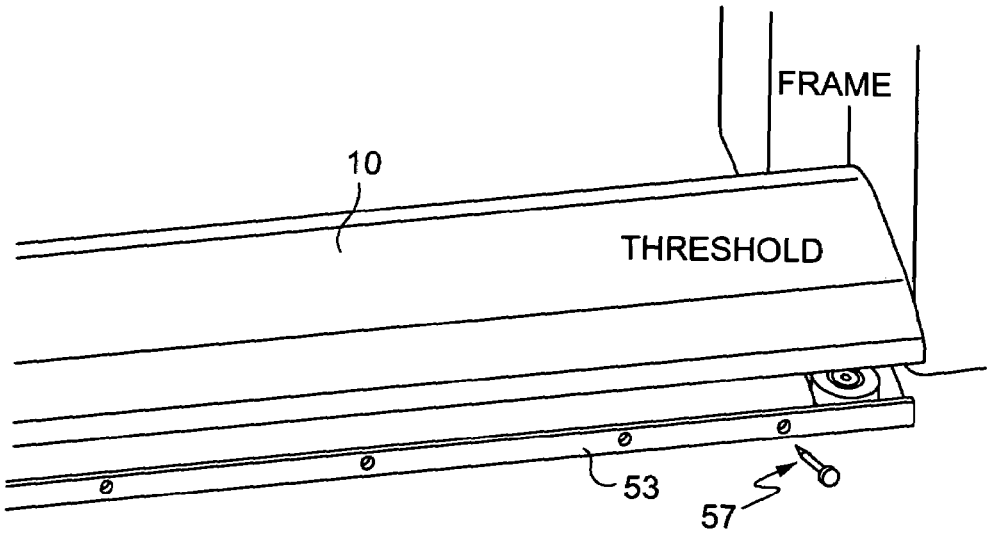
Figure 8D:
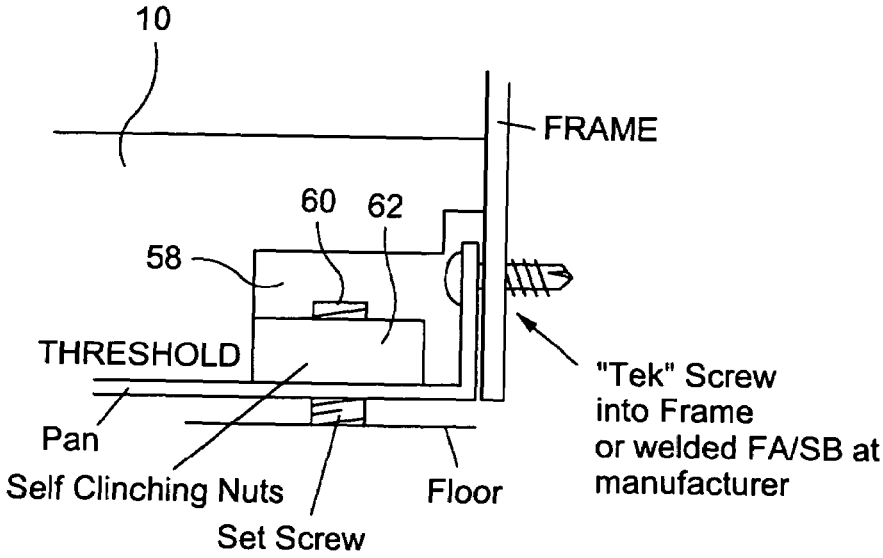
Figure 9A:
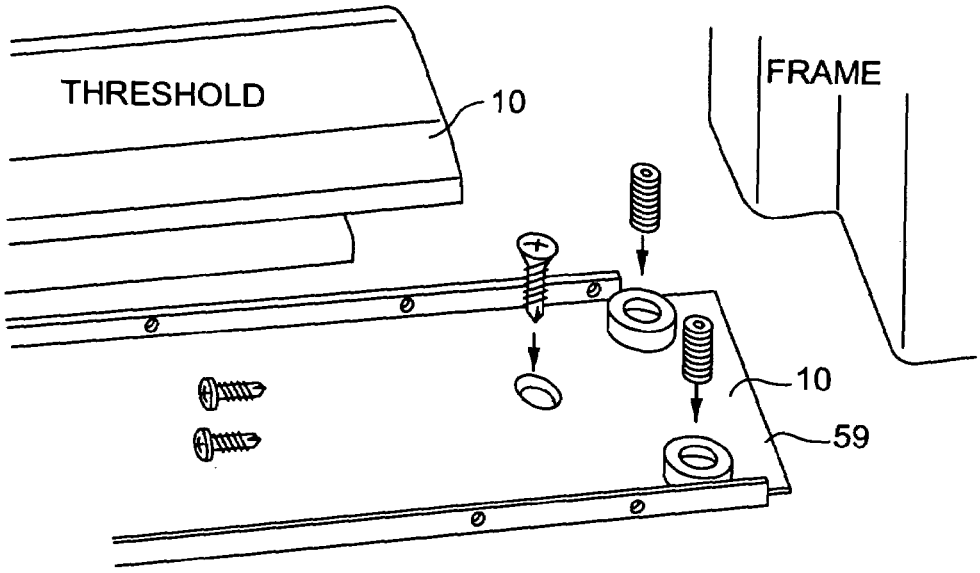
FIGS. 9(*a*), 9(*b*), 9(*c*) and 9(*d*) illustrate a door threshold structure according to another example embodiment of this invention combining the features of the FIGS. 2, 6, 7 and 8 embodiments, where the structure includes a door threshold similar to that of FIG. 2 being used in combination with a pan, levelers, and a locating bracket.
Figure 9B:
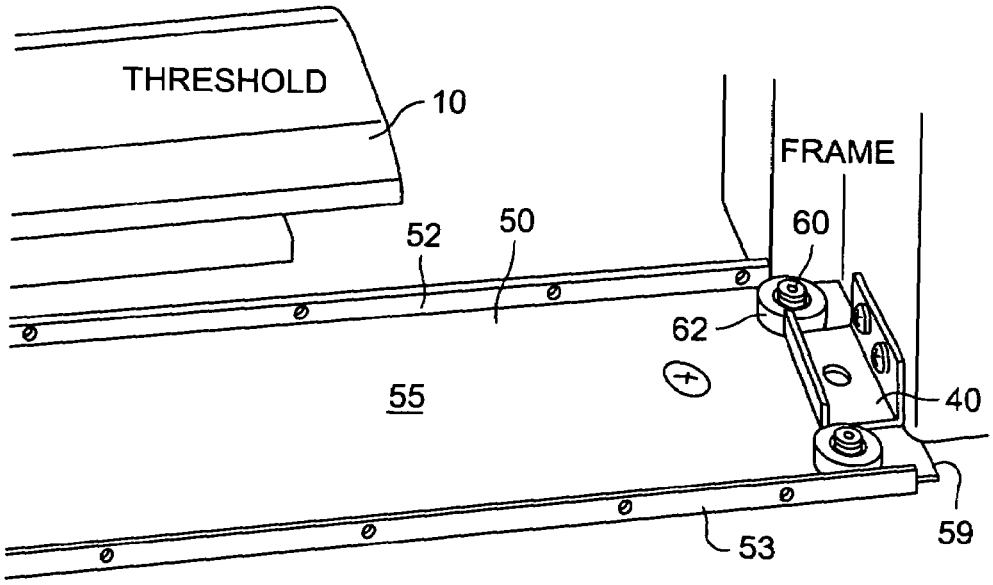
Figure 9C:
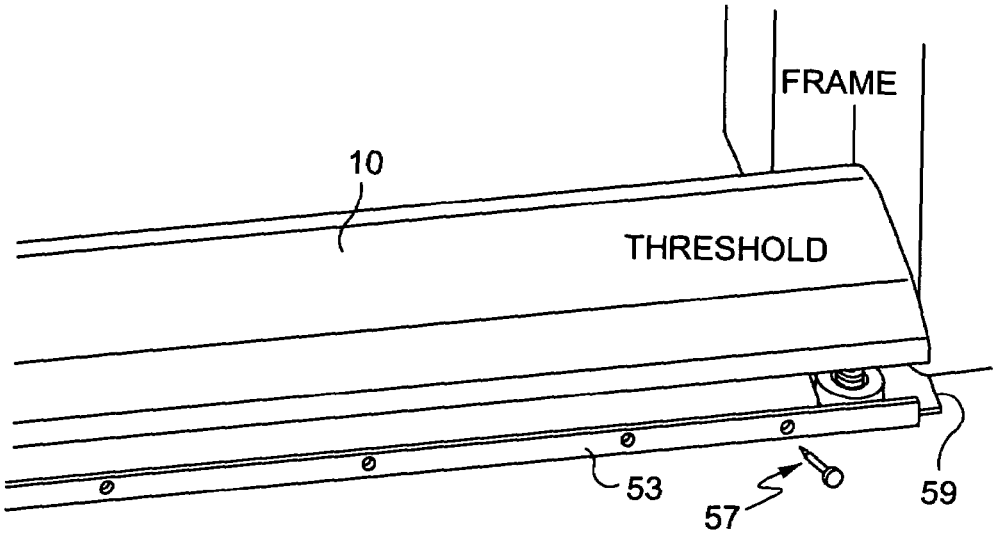
Figure 9D:
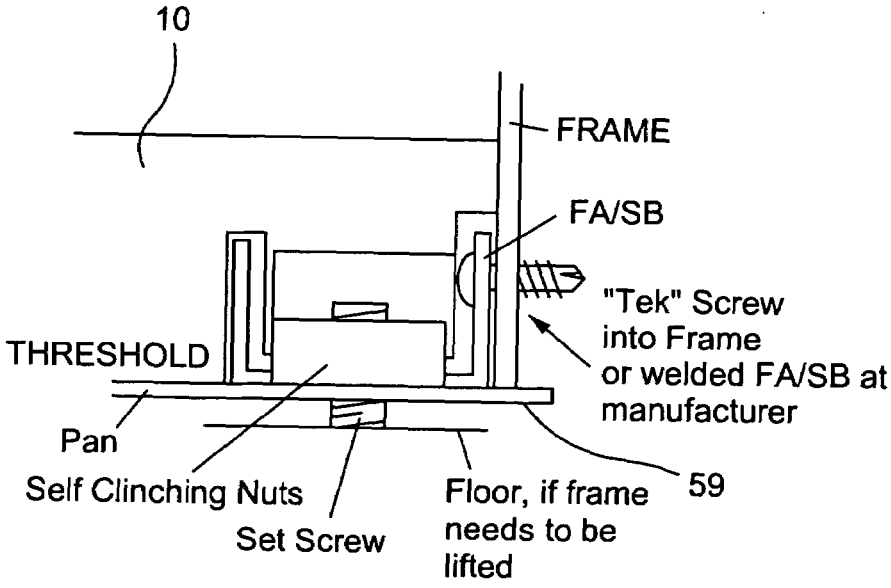
Figure 10A:
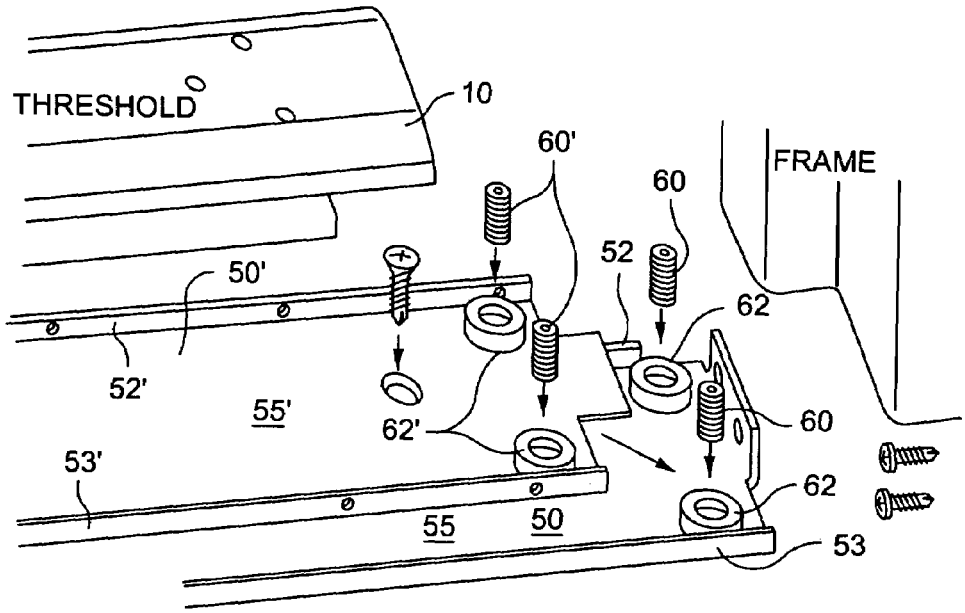
FIGS. 10(*a*), 10(*b*), 10(*c*) and 10(*d*) illustrate a door threshold structure according to another example embodiment of this invention, similar to the FIG. 8 embodiment except that multiple pans and levelers are used.
Figure 10B:
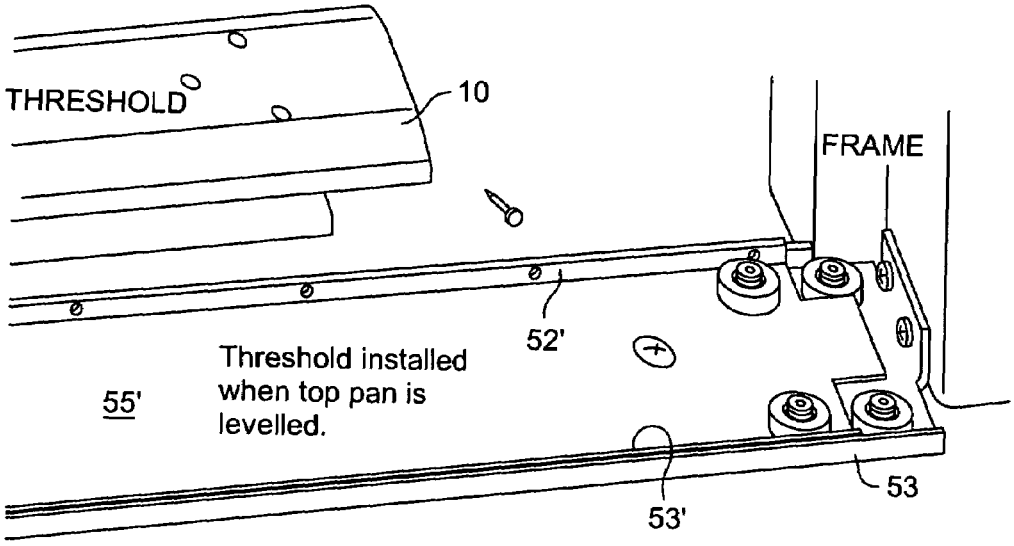
Figure 10C:
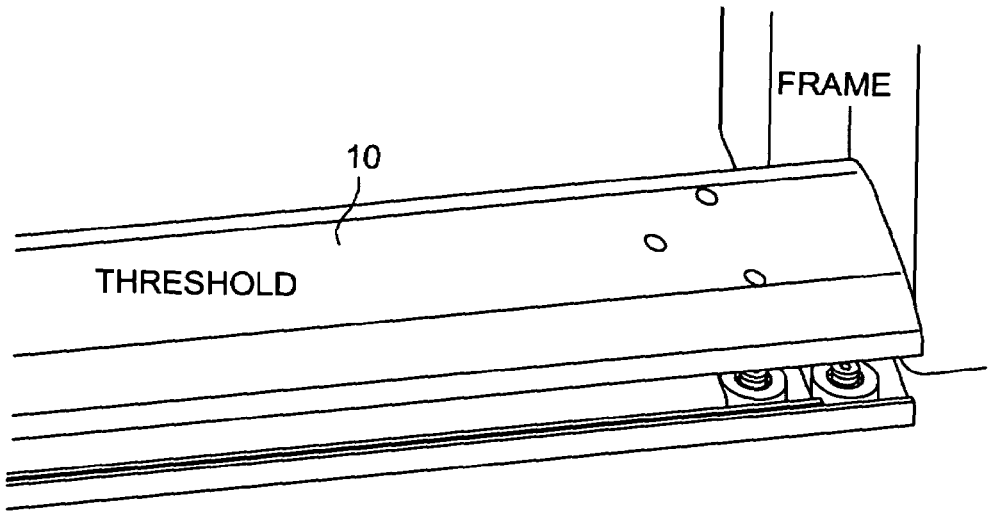
Figure 10D:
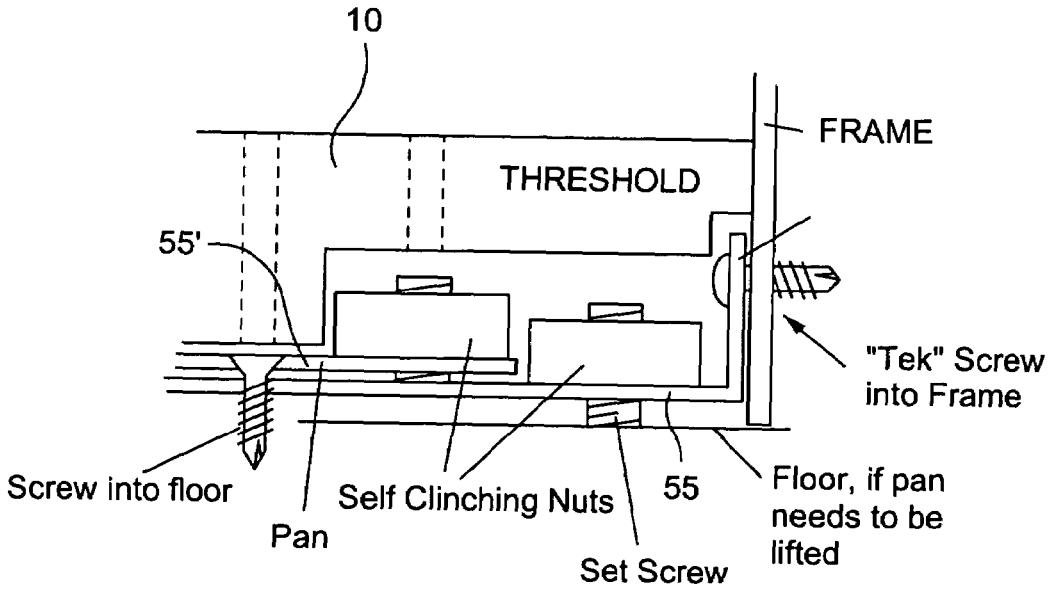
Figure 11A:
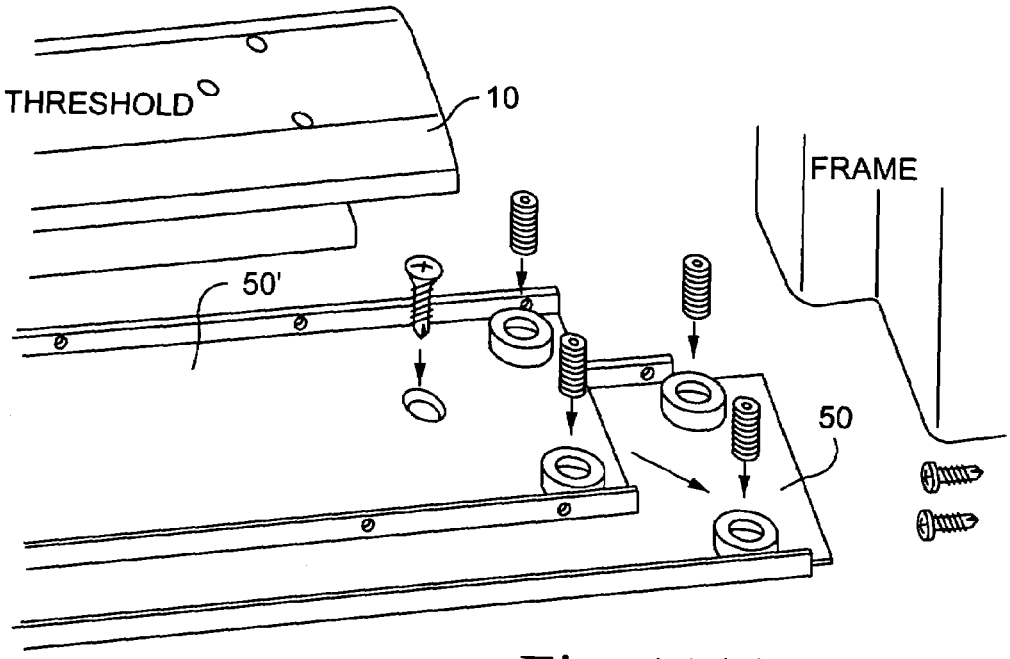
FIGS. 11(*a*), 11(*b*), 11(*c*) and 11(*d*) illustrate a door threshold structure according to another example embodiment of this invention, similar to the FIG. 9 embodiment except that multiple pans and levelers are used.
Figure 11B:
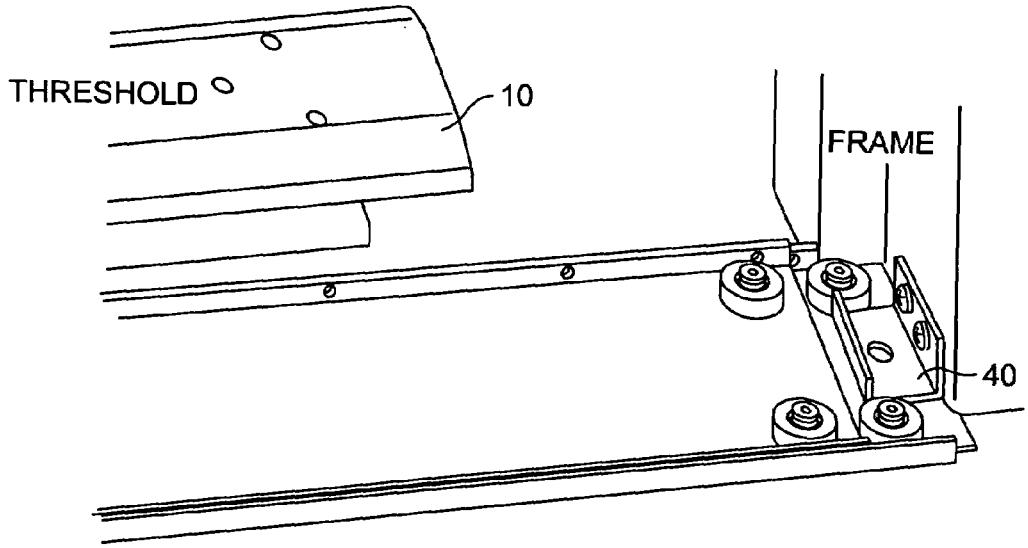
Figure 11C:
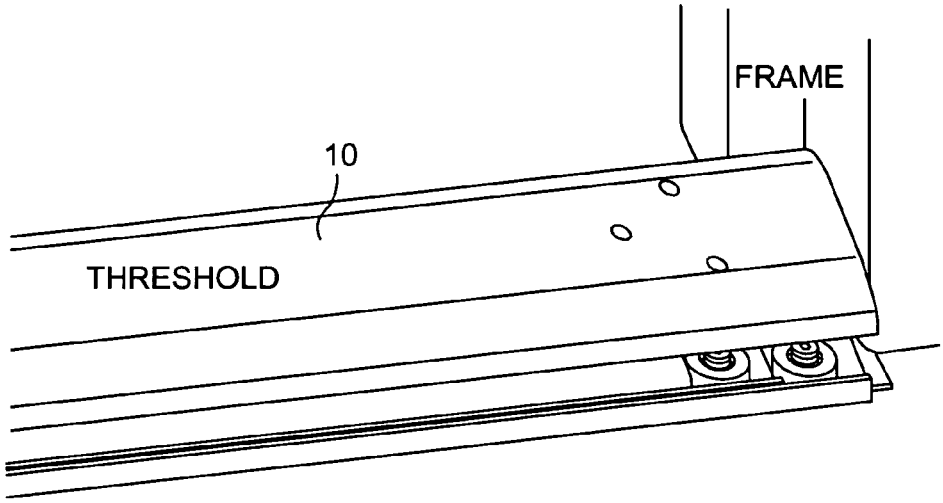
Figure 11D:
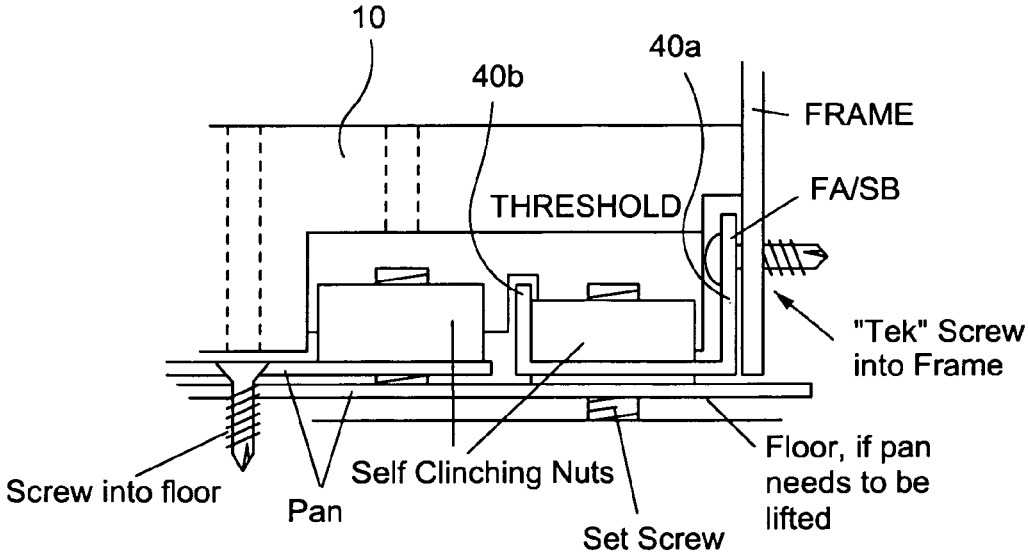

FIGS. 5(*a*)–5(*b*) are cross sectional views and illustrate an interlocking riser or elevator 30 that may be used with threshold 10 in accordance with certain example embodiments of this invention. The need for increasing the height of a threshold 10 sometimes arises. In such cases, interlocking riser or elevator 30 may be used and located under the threshold 10. The jagged lower surface of the threshold 10 interlocks with the jagged upper surface of the riser or elevator 30. For example, the interlocking surfaces of the riser 30 and threshold may be saw-tooth shaped as shown in FIGS. 5(*a*)–(*b*), or may be any other suitable shape capable of interlocking in different embodiments of this invention. Also, as shown in FIG. 5, the lower surface of the riser 30 may also be saw-tooth shaped in certain example embodiments of this invention, to aid in attachment to the floor or some other support member.

FIGS. 6(*a*)–6(*d*) illustrate a threshold structure including threshold 10 used in combination with a locating bracket 40 that is attached to a vertical surface of the door frame and/or to the floor. An example purpose of the bracket 40 is to help the door frame to be set to the desired width. The threshold 10 may be fit or attached to the bracket 40, so that the threshold structure is effectively used as a template for setting the frame.

Certain commercial door assemblies are not generally pre-assembled units with components such as hinges, doors, door bottoms, and thresholds. Instead, these components are typically installed at different times by different installers or contractors. Typically, a frame is set in place and then at a later date the door is hung in the frame and a door bottom may be installed. Often, at a later date the locks are installed and thresholds put in prior to carpet installation. As a result, the installation sequencing creates an environment in which each trade or contractor may cause a problem for the next. Such problems often lead to door frames being out-of-square, improper door operation, or other hardware that cannot be properly set. Thus, it can be seen that there exists a need in the art for a structure which can help control installation sequencing and maintain the expected/desired tolerances for plumb and square so that openings can properly operate as a system. For instance, there is a need to provide a system to maintain proper/desired clearances between the door and frame, and to ensure that the proper frame width is maintained. There affect door closing, locking and securing.

In this respect, reference is made to FIGS. 6(*a*)–(*d*). In this embodiment, threshold is fitted for and used in conjunction with bracket 40. Bracket 40 may be substantially U-shaped as viewed from an end thereof as shown in FIGS. 6(*a*)-(*d*), so as to have first and second spaced apart parallel vertical members 40*a* and 40*b* connected via base 40*c*. One of the vertical members 40*a* of bracket 40 is attached to a vertical wall of the door frame via screw(s), welding, or the like, while the other vertical member 40*b* of the bracket 40 extends upwardly and is adapted to fit into a slit 42 defined in the bottom of threshold 10. Slit 42 may be defined in bottom member 14 and/or the main body of the threshold. One purpose of the bracket 40 is to ensure that the frame is set exactly to the desired door frame width (e.g., 36 inches is a common frame width).

An example installation will herein after be described for the FIG. 6 embodiment. First, the bracket 40 is attached to the frame by screws, welding or the like as shown in FIGS. 6(*a*)–(*b*). The threshold 10 is then attached to the bracket 40 by locating the threshold over the bracket and moving it downward so that the one vertical member 40*b* of the bracket 40 slides into slit 42 in the threshold so that the threshold and bracket are connected in an interlocking manner as shown in FIGS. 6(*c*)–(*d*). Slit 42, and the vertical member 40*b* of the bracket 40 therein, prevent the threshold from laterally moving in the door frame once the interlocking attachment of the threshold and bracket has been made. Then, the threshold 10 attached to the bracket 40 is used as a template for setting the frame; this forces the door frame to be spread to the desired width in accordance with the threshold length thereby ensuring that there is no significant frame twist or out-of-plumb issue regarding the same. In other words, the threshold 10 as attached to the bracket 40 acts as a template to square up the frame and align the same during installation.

Still referring to FIG. 6, the threshold 10 may, after the frame has been installed, be removed from bracket 40 during construction. When this occurs, bracket 40 generally remains within the confines of the door stop of the frame and does not present a tripping hazard for contractors after threshold removal. When it is time to install carpet 4, the threshold 10 again fits over bracket 40 so that member 40*b* slides into slit 42 thereby indicating that the frame is still properly positioned. Carpet 4 is located between members 12 and 14 of the threshold 10 as described above. If the bracket member 40*b* cannot properly fit into threshold slit 42, this indicates that the frame tolerances/alignment has been improperly altered and frame repositioning may be required so that the member 40*b* may fit into slit 42 properly; again, this helps the door frame to be properly aligned once final construction has been completed. This may be used as a field quality check. The threshold 40 may be finally installed with glue or the like.

As an example, if the base of a typical steel frame is not anchored securely to the floor, or at least to a runner, stud or wall, the frame may easily twist out of alignment and/or lose its proper width. Similarly, if the base of one or both jambs is spread, it is possible to "pop" open the latch of the lock and open the door even if it is supposed to be locked (i.e., an unauthorized break-in). In other words, if the frame is too wide, this will defeat the security of the lock. However, the instant threshold and bracket 40 combination permit the proper width of the frame to be maintained, and allow proper frame final installation, thereby avoiding these problems.

FIGS. 7(*a*)–(*d*) illustrate another threshold structure according to another embodiment of this invention, where the structure includes threshold 10 used in combination with a pan 50. Pan 50 includes a base 51 which is substantially perpendicular (i.e., perpendicular plus/minus 20 degrees) to vertical pan members 52, 53 and 54. Vertical members 52 and 53 are substantially parallel to one another and may be referred to as pan sidewalls or tabs. A cavity is defined between vertical members 52, 53 and 54. After the pan 50 has been attached to the door frame and/or floor, the threshold 10 is located thereon between the pan sidewalls (or tabs) 52 and 53. The affixing of the pan 50 to both sides of the door frame prevents and/or reduces undesirable spreading of the frame at the base thereof, thereby improving lock functionality and securing as described above.

An example installation of the threshold structure of FIG. 7 will now be described with reference to FIGS. 7(*a*)–(*d*). First, the pan 50 is attached to the door frame via screw(s), weld(s) or the like. The pan 50 may be fastened to the door frame by attaching the vertical member 54 to the frame as shown in FIGS. 7(*a*)–(*b*). The pan 50 may be attached to the frame at the factory, or in the field, in different embodiments of this invention. In this respect, the pan 50 attached to the frame prevents spreading of the frame base thereby allowing the frame width to be substantially maintained. This is advantageous for the reasons discussed above, with respect to door closing, locking and security. As another example advantageous, the pan 50 in this respect may prevent frame spreading in leau of conventional welded temporary spreader bars. Optionally, the pan may also be attached to the floor or the like via screw(s) provided in base 55 (e.g., see FIG. 7(*b*)). The pan (without or without threshold 10 attached thereto) may be used as a template for setting the frame; this forces the door frame to be spread to the desired width in accordance with the pan length thereby ensuring that there is no significant frame twist or out-of-plumb issue regarding the same. In other words, the pan 50 acts as a template to square up the door frame and align the same during installation.

During construction, after original installation of the frame, the pan 50 may be removed from the door frame. However, before final installation of carpeting and the like, the pan 50 is re-attached to the door frame as shown in FIG. 7(*b*). Then, the threshold 10 is inserted into the cavity in the pan 50 so as to be located between the pan's vertical members 52, 53 and 54, as shown in FIGS. 7(*c*)–(*d*). Pan sidewalls or tabs 52 and 53 prevent the threshold 10 from moving out from under the door area. The threshold 10 may be attached to pan 50 via adhesive, screw(s), nail(s) or the like in different embodiments of this invention, and carpet 4 may be inserted between threshold members 12 and 14 as described above. In certain example embodiments, nails 57 may be inserted through sidewalls 52 and/or 53 and into the threshold 10 in order to attach the threshold to the pan 50.

FIGS. 8(*a*)–(*d*) illustrate another embodiment of this invention. The FIG. 8 embodiment is the same as the FIG. 7 embodiment, except that levelers are provided in order to compensate for non-level flooring. One or both sides of the pan 50 may be raised and/or lowered by the leveler(s) shown in FIGS. 8(*a*)–(*d*). The leveling of the pan (and thus of the frame) may be done before the frame is attached to the pan in certain example embodiments. Level thresholds prevent frame spreading at the base in an advantageous manner. In the FIG. 8 embodiment, each leveler includes a set screw 60 and a support 62 (e.g., self clinching nut) threadedly engaged therewith. The level of one or both sides of the pan and/or frame may be adjusted by turning screw(s) 60 and/or support(s) 62 attached thereto. Optionally, mortar may be floated under the pan 50 for support and/or fire protection. The threshold 10 may be installed over or on the pan 50 as described above; however, in this embodiment cavities or cut-outs 58 may be defined in the bottom and/or side surface(s) of the threshold in areas over the levelers (e.g., see especially FIGS. 8(*c*)–(*d*). Levelers (and thus cavities/cut-outs 58) may be provided at each of the four corners of the pan in certain example embodiment of this invention.

For example, floors poured out of level require frames to be adjusted accordingly. In the FIG. 8(*a*)–(*d*) embodiment, the pan 50 may serve to eliminate field shim(s) under the frame. Before the pan 50 is attached to the frame for final installation, the levelers 60, 62 may be used to level the same by adjusting screws 60. Thereafter, mortar may be floated under the pan 50 for sound and/or fire protection. Thus, the leveling of the door frame and the threshold is combined using the structure of the FIG. 8(*a*)–(*d*) embodiment.

FIGS. 9(*a*)–(*d*) illustrate another example embodiment of this invention. This embodiment combines the embodiments of FIGS. 6–8. Thus, the FIG. 9 embodiment utilizes pan 50 (absent vertical member 54), bracket 40, and levelers 60, 62. As best shown in FIG. 9(*b*), the bracket 40 may in certain instances be located between a pair of levelers 60, 62. Moreover, an end 59 of the pan base 55 in this embodiment may slide beneath the frame and thus be located under part of the door frame in order to support or jack the frame.

FIGS. 10(*a*)–(*d*) illustrate another example embodiment of this invention. The FIG. 10 embodiment is the same as the FIG. 8 embodiment, except that a second pan 50' (including sidewalls 52' and 53') is provided and is located over the first pan 50. Additional levelers 60', 62' may also be provided, through and/or over the second pan 50'. The threshold is installed over and within the second pan 50' as shown in FIGS. 10(*c*)–(*d*). The additional levelers include screws 60' that extend through the base 55' of the second or higher pan 50' but which are supported by the base 55 of the first or lower pan 50 (e.g., see FIGS. 10(*c*)–(*d*)). This structure allows the heights of the frame and/or threshold to be more easily adjusted if need be. As with the other embodiments herein, the illustrated structure shown in FIGS. 10(*a*)–(*d*) is typically provided at both ends of the threshold structure (although only one end is illustrated for purposes of simplicity).

Still referring to the FIG. 10(*a*)–(*d*) embodiment, when a fixed door sweep is used it is often desirable to have an adjustable threshold. In this respect, there may be a need to compensate with a base pan for non-level flooring, and there may be a need to adjust the level of the threshold if a floor settles and creates a non-level condition. In the FIG. 10 embodiment, the top pan 50' and the levelers 60', 62' thereof are used to adjust the threshold 10 height relative to the bottom pan 50 after installation, thereby allowing for side to side adjustment in the future if the floor settles or if the frame moves allowing the door to sag.

FIGS. 11(*a*)–(*d*) illustrate another example embodiment of this invention. The FIG. 11 embodiment combines the embodiments of FIGS. 6(*a*)–(*d*) and 10(*a*)-(*d*). In other words, the bracket 40 of the FIG. 6 embodiment is used in conjunction with the FIG. 10 embodiment. The bottom pan can adjust the height and level of the frame as discussed above with respect to the FIG. 10 embodiment. This embodiment may be desirable in situations, for example, where frames are set prior to gypcrete being poured as a final flooring surface. The top pan 50' can then be installed at a later date and used to adjust the threshold 10 height after installation thereof, thereby allowing for side to side adjustment in the future if the floor settles or if the frame moves and allows door sagging. Moreover, as will all other pan embodiments herein, the leveling pan can be used as a base for the threshold to compensate for dips and/or crowns in the floor; the latter condition may necessitate elevating one or both legs of the jambs in order to maintain the square of the frame and door.

Figure 12A:
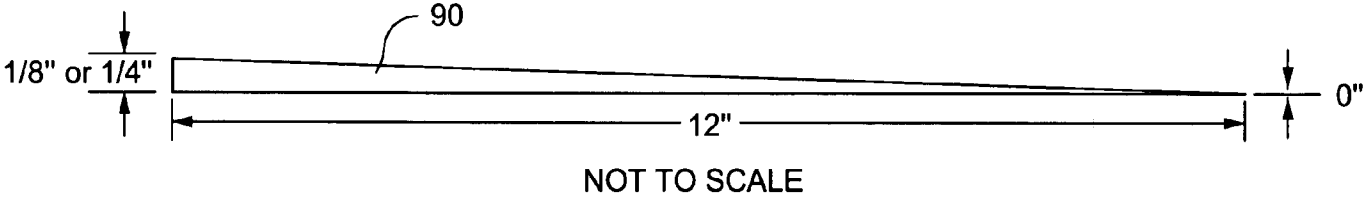
FIGS. 12(*a*), 12(*b*) and 12(*c*) illustrate another example embodiment of this invention, where any of the threshold structures according to any of the other embodiments herein may be used with one or more leveling shim(s) in order to compensate for non-level flooring.
Figure 12B:
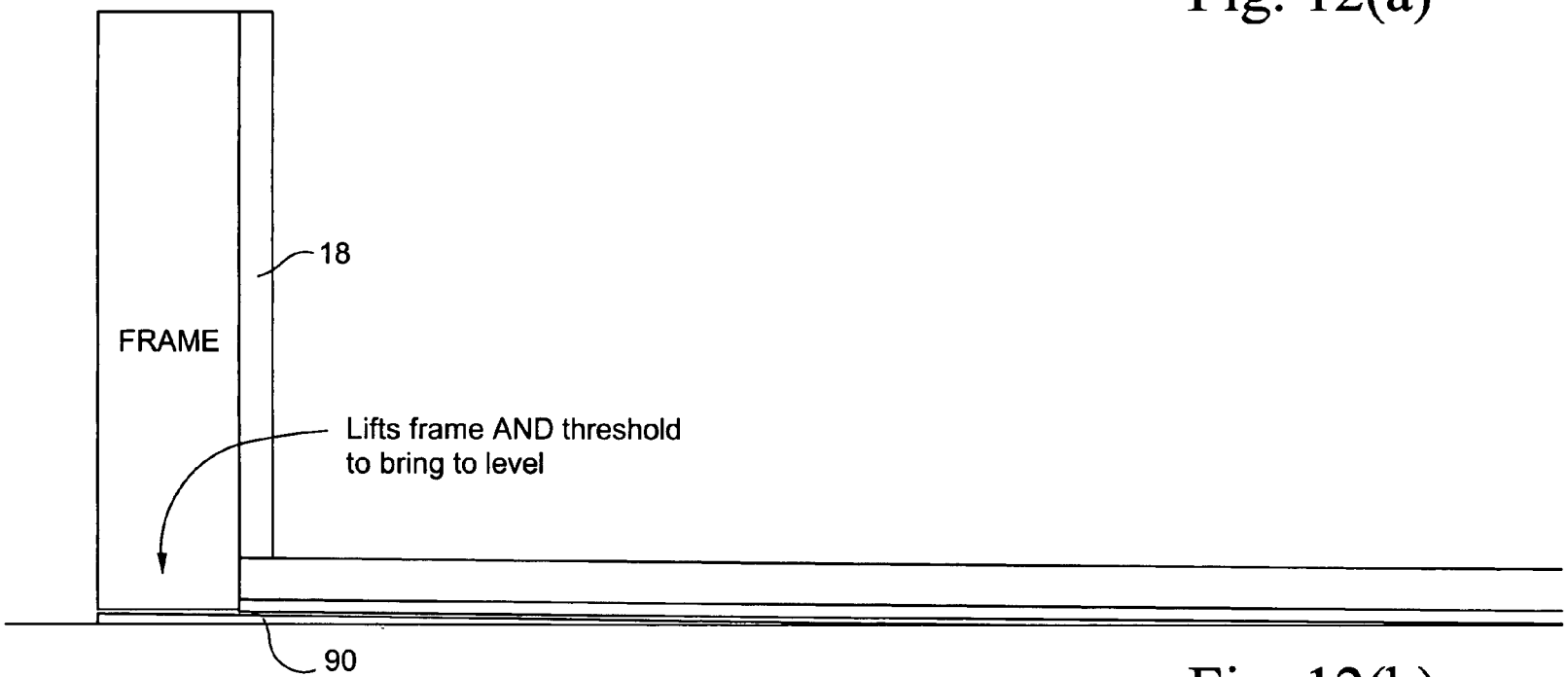
Figure 12C:
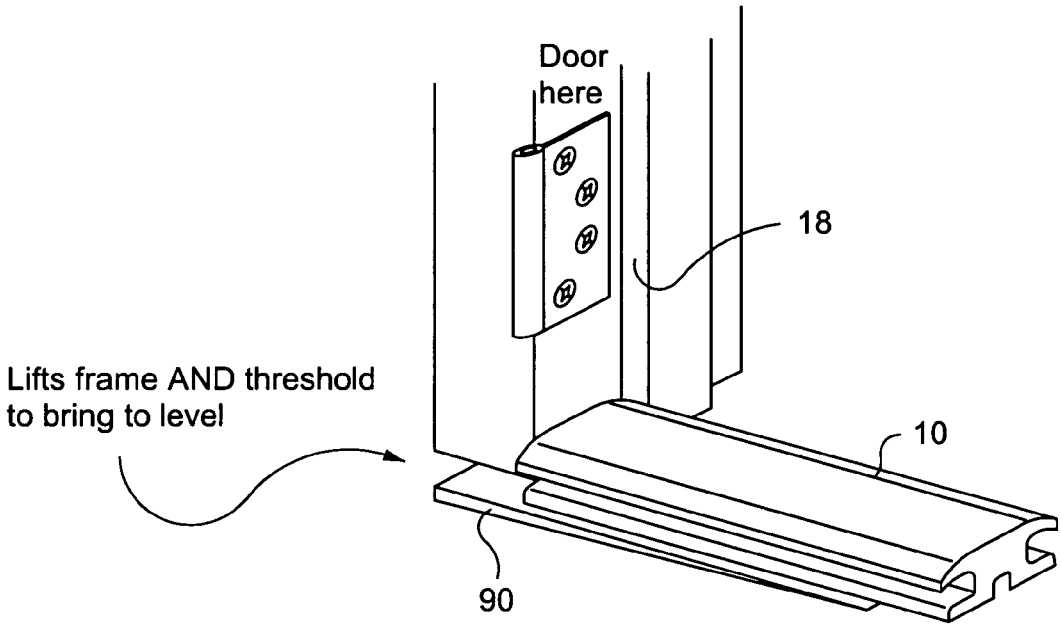

FIGS. 12(*a*)–(*c*) illustrate another way to make adjustments for non-level flooring according to another example embodiment of this invention. If shimming of a frame is required to compensate for out-of-level flooring, a wedge-shaped floor leveling shim 90 may be used to level the threshold 10. FIG. 12(*a*) is a side plan view of the shim 90 itself, whereas FIGS. 12(*b*)–(*c*) illustrate the shim 90 located under the threshold 10 and frame. The shim may be attached to the floor and/or threshold 10 by glue, fasteners or the like.

For example, still referring to FIG. 12, if the door frame needs to be raised 3/16 of an inch on one side for out-of-level flooring, the shim 90 both acts as a support for the door frame (because is it partially located under the same) and also for the threshold 10 (because it is also under the same) in order to transition to the needed rise. Thus, the clearance under the door can be provided in a substantially uniform manner across the length of the threshold. Since the threshold and leveler shim 90 may be fire rated, it may also provide a fire rated means of supporting the frame in certain example embodiments of this invention.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. A door threshold structure to be at least partially located beneath a door when the door is in a closed position, in combination with a carpet, the door threshold structure comprising:

a door threshold including a main body;

wherein, on at least one side of the main body of the door threshold, there are provided upper and lower members extending from the main body in spaced apart relation from one another so that the upper and lower members are at least partially substantially parallel to one another;

the carpet located adjacent the threshold;

wherein a gap between the spaced apart upper and lower members receives an end of said carpet;

an elongated first pan mounted to opposing sides of a door frame, and further being located at least partially beneath the door threshold so as to at least partially support the door threshold;

the pan comprising first and second spaced apart vertically extending sidewalls; and wherein the door threshold is mounted on the pan between the first and second spaced apart vertically extending sidewalls of the pan.

2. The door threshold structure of claim 1, wherein additional upper and lower members extend from the main body from another side thereof and define another gap therebetween for receiving an end of another piece of carpet.

3. The door threshold structure of claim 1, wherein the upper member is flexible and an end thereof is biased downwardly toward an end of the bottom member in order to grip the carpet that is located between the upper and lower members.

4. The door threshold structure of claim 1, wherein a base of the door threshold comprises first and second feet which are spaced apart from one another, each of the feet being at least part of a lower member and having a bottom surface that is saw-tooth shaped.

5. The door threshold structure of claim 1, wherein at least part of a bottom surface of the door threshold is saw-tooth shaped.

6. The door threshold structure of claim 1, further comprising a riser located beneath the door threshold, wherein an upper surface of the riser and a lower surface of the door threshold are engaged in an interlocking manner so that the riser is used to adjust a height of the door threshold.

7. The door threshold structure of claim 1, wherein a sweep having a plurality of flexible fins is provided at the bottom of the door located above the threshold when the door is in the closed position.

8. The door threshold structure of claim 1, further comprising first and second spaced apart levelers, each of the first and second levelers comprising a screw and a support member threadedly engaged therewith, and wherein the screws of the levelers extend through respective apertures in a base portion of the pan and can be used to adjust a height of the door frame.

9. The door threshold structure of claim 1, further comprising:

a bracket to be mounted to the door frame and over at least part of the pan, wherein the bracket comprises first and second spaced apart and substantially parallel vertically extending members;

wherein the first vertically extending member of the bracket is attached to the door frame, and the second vertically extending member of the bracket is located at least partially in a slit defined in the door threshold.

10. The door threshold structure of claim 1, further comprising a second pan located at least partially over the first pan, wherein sidewalls of the second pan are located between the sidewalls of the first pan.

11. The door threshold structure of claim 10, further comprising levelers located at least partially between the first and second pans so that a height of the threshold can be adjusted relative to the first pan via said levelers.

12. The door threshold structure of claim 1, further comprising a wedge-shaped shim located under both a door frame and at least part of the door threshold.

* * * * *